US006309119B1

(12) United States Patent
Buckley et al.

(10) Patent No.: US 6,309,119 B1
(45) Date of Patent: Oct. 30, 2001

(54) TAPE STORING AND FEEDING MECHANISM FOR MAILING MACHINES

(75) Inventors: Franklin J. Buckley, Bethel; Gerald C. Freeman, Norwalk, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/645,979

(22) Filed: Apr. 21, 2000

Related U.S. Application Data

(63) Continuation of application No. 09/073,534, filed on May 6, 1998, now Pat. No. 6,224,280.

(51) Int. Cl.[7] ..... B41J 11/26

(52) U.S. Cl. ..... 400/621; 101/227; 83/62; 83/105; 347/104

(58) Field of Search ..... 400/621, 621.1; 101/226, 227; 347/104; 83/62, 105

(56) References Cited

U.S. PATENT DOCUMENTS

| | | | | |
|---|---|---|---|---|
| 1,958,355 | | 5/1934 | Wheeler, Jr. et al. | 101/91 |
| 2,332,152 | | 10/1943 | Knauer | 271/2.4 |
| 2,533,317 | | 12/1950 | Hanson | 101/227 |
| 3,401,630 | | 9/1968 | Goodrich, Jr. et al. | 101/228 |
| 3,427,968 | | 2/1969 | Viola | 101/228 |
| 3,664,597 | | 5/1972 | Norman, et al. | 242/75.4 |
| 3,712,527 | | 1/1973 | Luperti, et al. | 226/136 |
| 3,749,013 | | 7/1973 | Ellner | 101/227 |
| 3,855,041 | | 12/1974 | Kunisch | 156/442.2 |
| 4,389,009 | | 6/1983 | Yamashita | 226/188 |
| 4,478,143 | * | 10/1984 | Hendrischk et al. | 101/93.05 |
| 4,568,950 | | 2/1986 | Ross, et al. | 346/76 PH |
| 4,877,197 | | 10/1989 | Nelson, et al. | 242/68.7 |
| 4,922,085 | | 5/1990 | Dannatt, et al. | 235/101 |
| 4,957,179 | | 9/1990 | Dannatt | 177/145 |
| 5,041,845 | * | 8/1991 | Ohkubo et al. | 400/621 |
| 5,174,824 | | 12/1992 | Salancy, et al. | 118/253 |
| 5,175,518 | | 12/1992 | Swanson, Jr. | 333/168 |
| 5,378,070 | | 1/1995 | Lyga | 400/615.2 |
| 5,379,692 | | 1/1995 | Haug | 101/227 |
| 5,392,703 | * | 2/1995 | Makarchuk | 400/621 |
| 5,415,484 | * | 5/1995 | Gallagher et al. | 400/621 |
| 5,431,077 | * | 7/1995 | Murikama | 83/62 |

(List continued on next page.)

FOREIGN PATENT DOCUMENTS

| | | | |
|---|---|---|---|
| 0699537A2 | 3/1996 | (EP) | B41J/13/10 |
| 07214835 | 8/1995 | (JP) | B41J/11/70 |
| 08002754 | 1/1996 | (JP) | B65H/19/12 |
| 09001883A | 1/1997 | (JP) | B41J/15/04 |

*Primary Examiner*—Eugene Eickholt
(74) *Attorney, Agent, or Firm*—Steven J. Shapiro; Michael E. Melton

(57) ABSTRACT

A high speed, high volume mailing machine which utilizes ink jet technology for the printing of postage indicia on envelopes being fed through the mailing machine and on discrete portions of tape fed past the printing device of the mailing machine includes a tape storing and feeding mechanism which stores a roll of tape in the form of a web of indefinite length for feeding a discrete portion of the tape past the feeding device for each printing operation of the mailing machine, and feeds the tape forward to bring the printed portion thereof past and then reverses the movement of the tape to bring the new leading edge thereof to the beginning of the printing area. The tape storing and feeding mechanism provides a fixed support for the portion of the tape being printed on so as to maintain a critical gap between the surface of the tape and the plane of the jet nozzles to achieve a high printing quality. The tape storing and feeding mechanism also provides a feeding device which maintains effective control over the movement of the tape without contacting any part of the printed portion thereof, and further provides ample shock absorbing for the roll of tape so that sudden acceleration of the tape strip does not tear the tape in the printing area.

8 Claims, 8 Drawing Sheets

U.S. PATENT DOCUMENTS

| | | | |
|---|---|---|---|
| 5,467,709 | 11/1995 | Salomon | 101/93 |
| 5,520,766 | 5/1996 | Iwasaki | 156/277 |
| 5,734,405 | 3/1998 | Suzuki | 347/105 |
| 5,751,306 | 5/1998 | Sakaki, et al. | 347/22 |
| 5,874,979 | 2/1999 | Ohyama | 347/104 |
| 5,940,092 | 8/1999 | Kashimura, et al. | 347/8 |
| 6,118,462 * | 9/2000 | Hosomi | 347/200 |

* cited by examiner

TAPE STORING AND FEEDING MECHANISM FOR MAILING MACHINES

This application is a continuation of a prior application Ser. No. 09/073,534 filed on May 6, 1998 now U.S. Pat. No. 6,224,280.

BACKGROUND OF THE INVENTION

This invention relates generally to the field of ink jet printing, and more particularly to mailing machines which incorporate ink jet technology and have the capability of printing postage indicia either on envelopes fed successively through the mailing machine or on discrete lengths of tape that is stored in and dispensed from the mailing machine and then manually affixed to bulky mail pieces or packages.

Automatic high speed mailing machines of the type with which the present invention is utilized have long been well known and have achieved a high degree of commercial success. Mailing machines of this type typically include an elongated feed deck, an envelope conveyor mechanism extending along the feed deck, a hopper for holding a stack of envelopes with the flaps still open, a flap closing and sealing device located just downstream from the hopper, and a postage meter mounted over the feed deck just downstream from the flap closing and sealing device. The postage meter typically includes an accounting device for monitoring the amount of postage dispensed and a printing device for printing a postage indicia on the envelopes as they are fed along the feed deck. The postage meter further includes a postage amount setting mechanism by which the postage meter is manually set to print an appropriate amount of postage as required by the weight of the envelopes being fed through the mailing machine. Some of the more sophisticated mailing machines include an envelope weighing device interposed between the flap closing and sealing device for weighing each envelope as it passes over the weighing device and the postage meter for automatically setting the postage to print an appropriate amount of postage in the postage indicia.

Traditionally, from the earliest development of postage meters, the printing devices therein have utilized ink transfer technology, in which ink is transferred from a storage device to a rotary or flat bed printing die of the printing device, and the ink then being transferred from the printing die to the envelope, either by rotation of a curved printing die while the envelope is in motion, or by suitably pressing the envelope against the flat bed printing die. However, recent technological advances in the field of ink jet technology have resulted in this form of printing technology being adopted for use in postage meters, with the result that the printing devices in postage meters can now provide the same technical and operator advantages as are offered by ink jet technology in other types of printing applications.

One of the most significant problems that had to be overcome in adapting postage meters for use with ink jet technology was that of establishing and maintaining a proper physical orientation between the surface of an envelope traveling through the mailing machine on which the postage indicia was to be printed or between the surface of a piece of tape stored in the mailing machine on which the postage indicia was to be printed. In all prior mailing machines which utilized ink transfer technology, both the envelopes and the tape on which the postage indicia was printed were supported by a fixed surface against which the rotary or flat bed printing die pressed the envelope or piece of tape in order to effectively transfer the ink from the die to the surface of the envelope or tape. It must be remembered that a postage meter, in effect, is printing an indicia that is the equivalent of money, and therefore the print quality of the indicia must meet certain minimum standards for this type of printing established by the local Postal Authority. It was therefore critical that an effective and reliable die to envelope or tape surface pressure contact be obtained for each printing operation to ensure that the required printing quality was obtained. This presented little problem with the prior arrangement of providing a printing die which pressed against a printing surface which in turn was rigidly supported by a fixed surface during the printing operation.

All of this changed with the advent of ink jet technology in the postage meter field. In order for the ink jet nozzles of any ink jet printer to deposit ink on the surface of a receiving medium, it is critical that a small predetermined gap be maintained between the exit plane of the nozzles and the surface of the receiving medium, typically in the order of one sixteenth to one thirty-second of an inch. This gap is necessary to achieve proper and acceptable image quality, since too small a gap causes excessive ink to be deposited in the actual image area, resulting in a poor image quality, and too large a gap results in an image that appears fuzzy or out of focus. In heretofore conventional printing devices utilizing ink jet technology, such as computer printers, maintaining this gap was not a problem because the sheet of paper on which printing was taking place was always supported on a rigid, stationary surface while printing is taking place. For example, in a typical printer, the sheet of paper is typically wrapped partly around a roller and the ink jet print head moves laterally across the sheet to produce a line of print. When a full line has been printed, the sheet is indexed to the next line, and the print head moves across the sheet to print a second line, and so on until the printing operation is complete. In addition, in conventional ink jet printers, the item being printed upon does not vary in thickness so that, as long as the sheet remains flat on the supporting surface, there will be no variation in the gap between the printing surface and the plane of the ink jet nozzles. Also, conventional printers utilize a motor to drive the roll and then feed the tape web across the print means. The orientation of the motor connected to the roll employs a larger motor such that the inertia of the roll can be overcome. However, these large motors are expensive and, due to the large force, may tear or inconsistently feed the tape web.

The problem of maintaining the critical gap between the surface of an envelope and the plane of the ink jet nozzles was effectively solved with the invention disclosed and claimed in U.S. patent application Ser. No. 08/951,073 filed on Oct. 15, 1997 entitled MAILING MACHINE HAVING REGISTRATION SHIELD FOR INK JET PRINTING ON ENVELOPES and assigned to the assignee of this application. However, the invention disclosed and claimed in that application did not solve the problems inherent in utilizing ink jet technology in a postage meter to print a postage indicia on a discrete length of tape stored in the mailing machine. Since the thickness of the tape does not vary as it does with envelopes, the top registration invention of the prior application was not applicable to printing on tape. Also, once printing occurs on the envelope, it is ejected from the mailing machine and he next envelope is immediately presented to the printing vice. With tape, on the other hand, when printing takes place on a discrete portion of the tape, which is typically stored in roll form and fed as a web, the tape must be advanced to a position where the printed portion can be severed from the web and ejected from the mailing machine, after which the tape must be fed in a reverse direction to bring the new leading edge of the web to the printing position, thereby avoiding what would otherwise be an unacceptable degree of waste of tape each time an indicia is printed. Still further, since the printed postage indicia is relatively small in relation to the surface area of an envelope, there is ample surface area available for engagement with the envelope of various types of feeding mechanisms to move the envelope through the mailing machine after printing occurs without running the risk of smearing the ink within the postage indicia area by contact with any part of the feeding mechanisms. With the tape, on the other hand, the size of the postage indicia is such that it occupies a major portion of the height of the strip of tape, thereby leaving very little marginal portion of the tape for contact with any portion of a tape feeding mechanism for moving the tape forwardly for printing and severing and then backwards to realign the new leading edge of the tape with the beginning of a printing location. Finally, it has been found that mailing machines of the type with which ink jet technology is utilized for printing postage indicia on envelopes can operate at such a high rate of speed that typical tape storing and feeding mechanisms cannot operate successfully to commence feeding of the tape without running a high risk of tearing it, simply because the stored roll of tape cannot be accelerated fast enough to reduce the shock of the sudden acceleration on the tape, with the result that the tape frequently tears, and the mailing machine must be shut down to rethread the tape through the feeding mechanism.

Thus, despite the successful solutions to the problems of printing postage indicia on envelopes using ink jet technology, several significant problems remain in printing postage indicia on tape for later affixation to bulky envelopes and packages. And since this capability is an important contribution to the commercial acceptance of large, high volume mailing machine, there remains a critical need for the development of an effective mechanism for storing and feeding tape in a mailing machine on which postage indicia can be printed with the same degree of speed and acceptable print quality that has been achieved in connection with printing of envelopes.

BRIEF SUMMARY OF THE INVENTION

The present invention substantially obviates, if not entirely eliminates, the problems associated with the feeding of tape within a mailing machine, or other ink jet printer, for the purpose of printing a postage indicia, or other indicia, thereon utilizing ink jet technology. The present invention addresses each of the problems mentioned above in connection with the design of an effective tape storing and feeding mechanism for use in a mailing machine utilizing ink jet technology for printing a postage indicia on the tape. Thus, the present invention provides a tape storing and feeding device which effectively maintains the proper critical gap between the surface of the tape being printed upon and the plane of the ink jet nozzles in order to achieve the necessary degree of print quality, which provides a tape feeding mechanism that effectively moves the tape in both forward and reverse directions without contacting any portion of the printed postage indicia and smearing the ink thereon, and provides an effective solution to the problem of tearing the tape due to sudden acceleration of the tape in order to maintain a high speed of operation of the mailing machine.

In its broader aspects, the present invention is a tape storing and feeding mechanism for an ink jet printer which has at least one ink jet print head for printing at least a portion of an indicia on a portion of a tape stored in the printer, where the storing and feeding mechanism includes a storage mechanism mounted in the printer for storing a roll of tape, and an elongated tape feeding and supporting structure having an essentially flat upper surface mounted in the printer in axial juxtaposition with the tape storing mechanism and in vertical juxtaposition with the print head for feeding the web along the upper surface so that the web is disposed beneath and moves past the print head, and also includes upstream and downstream tape feeding mechanisms mounted at opposite ends of the tape supporting structure for feeding discrete portions along the tape supporting structure, so that the tape supporting structure supports the tape with a uniform separation from the print head to assure good print quality.

In accordance with one aspect of the subject invention, the tape supporting structure has a plurality of ribs projecting upwards and downwards from upper and lower surfaces of the supporting structure and extending substantially from one end of the supporting structure to the other, the upper edge portions of the upwardly projecting ribs defining the upper surface of the tape supporting structure. The ribs further provide a reservoir for collecting excess or waste ink which may result during printing.

In accordance with another aspect of the subject invention, the tape storing and feeding mechanism includes a cover having an upper element spaced from and substantially parallel to the upper surface of the tape supporting structure, the cover engaging latches on the side of the tape supporting structure, and having an opening approximate to the print head for printing the indicia on the tape.

In accordance with still another aspect of the subject invention, the upwardly projecting ribs are cut away adjacent to the print head so that the upper surface is not contaminated by ink discharged from the print head in the absence of tape and such ink can accumulate in the space between the ribs without interfering with the operation of the printer.

In accordance with still another aspect of the subject invention, the tape storage mechanism includes a first well for storing the roll of tape, the tape being fed from a bottom portion of the roll, upwards along a front wall of the well to the tape supporting and feeding mechanism, where the front wall includes an extended, resilient portion for absorbing a portion of the force applied to the web by the tape feeding and supporting means to accelerate the tape.

In accordance with still another aspect of the subject invention, the tape storage mechanism includes a second well located downstream of the first well for receiving a loop of the tape formed when the tape is advanced after printing to a position where the printed portion can be severed, and the tape is then returned to a position upstream from the print head.

In accordance with yet another aspect of the subject invention, the tape feeding means is driven by a motor operatively coupled to a first set of rollers, rather than at the tape roll, thus a smaller, less expensive motor can be used to drive the tape web.

Having briefly described the general nature of the present invention, it is a principal object thereof to provide an improved tape feeding mechanism which reliably and accurately maintains a proper spacing between an ink jet print head and the upper surface of a tape upon which an indicia is printed by the print head.

Other objects and advantages of the subject invention will be apparent to those skilled in the art from consideration of the detailed description set forth below and the attached drawings.

DETAILED DESCRIPTION OF THE INVENTION

Figure 1:
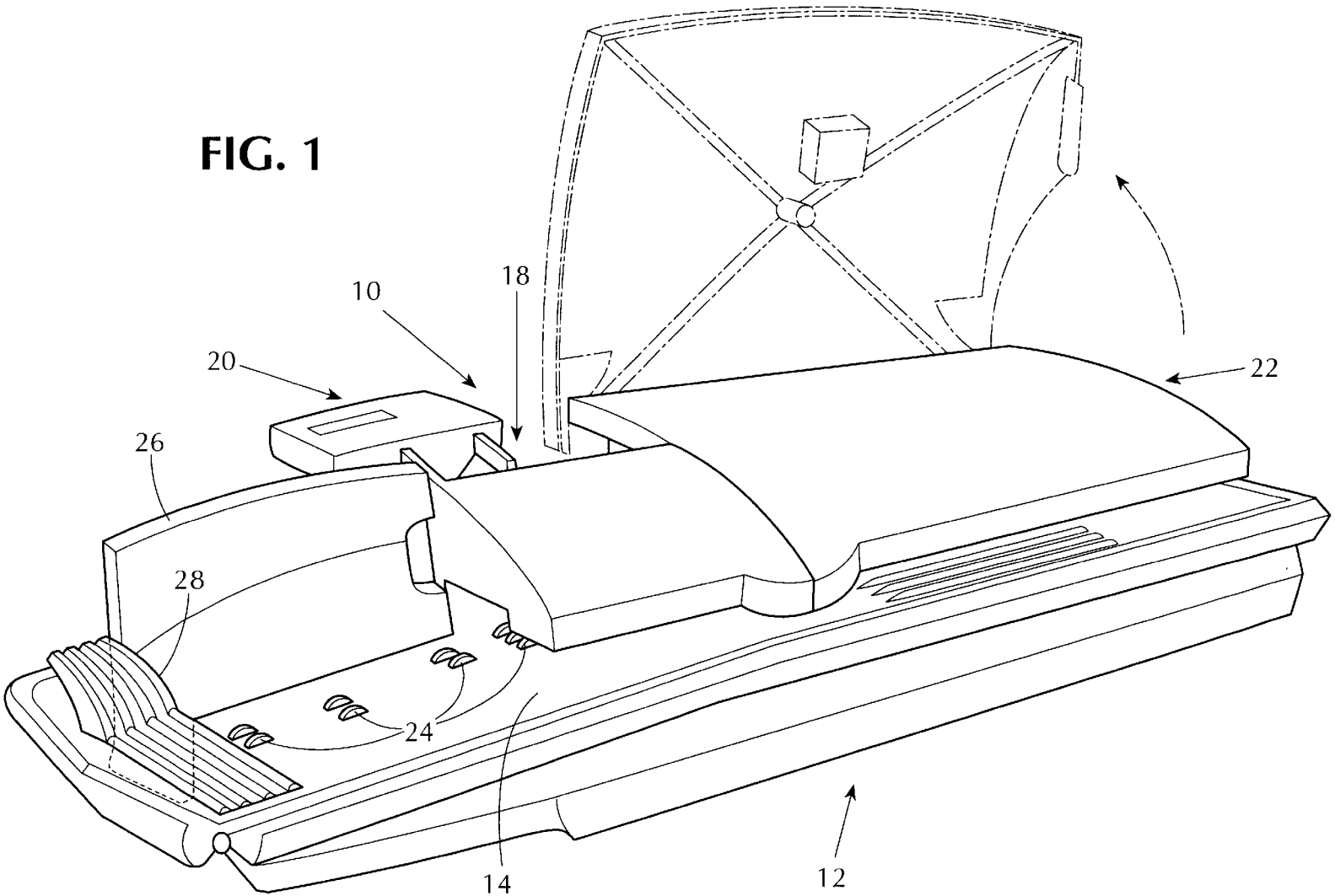
FIG. 1 is a perspective view of a representative automatic high speed mailing machine which includes the tape feeding mechanism of the present invention.
Figure 2:
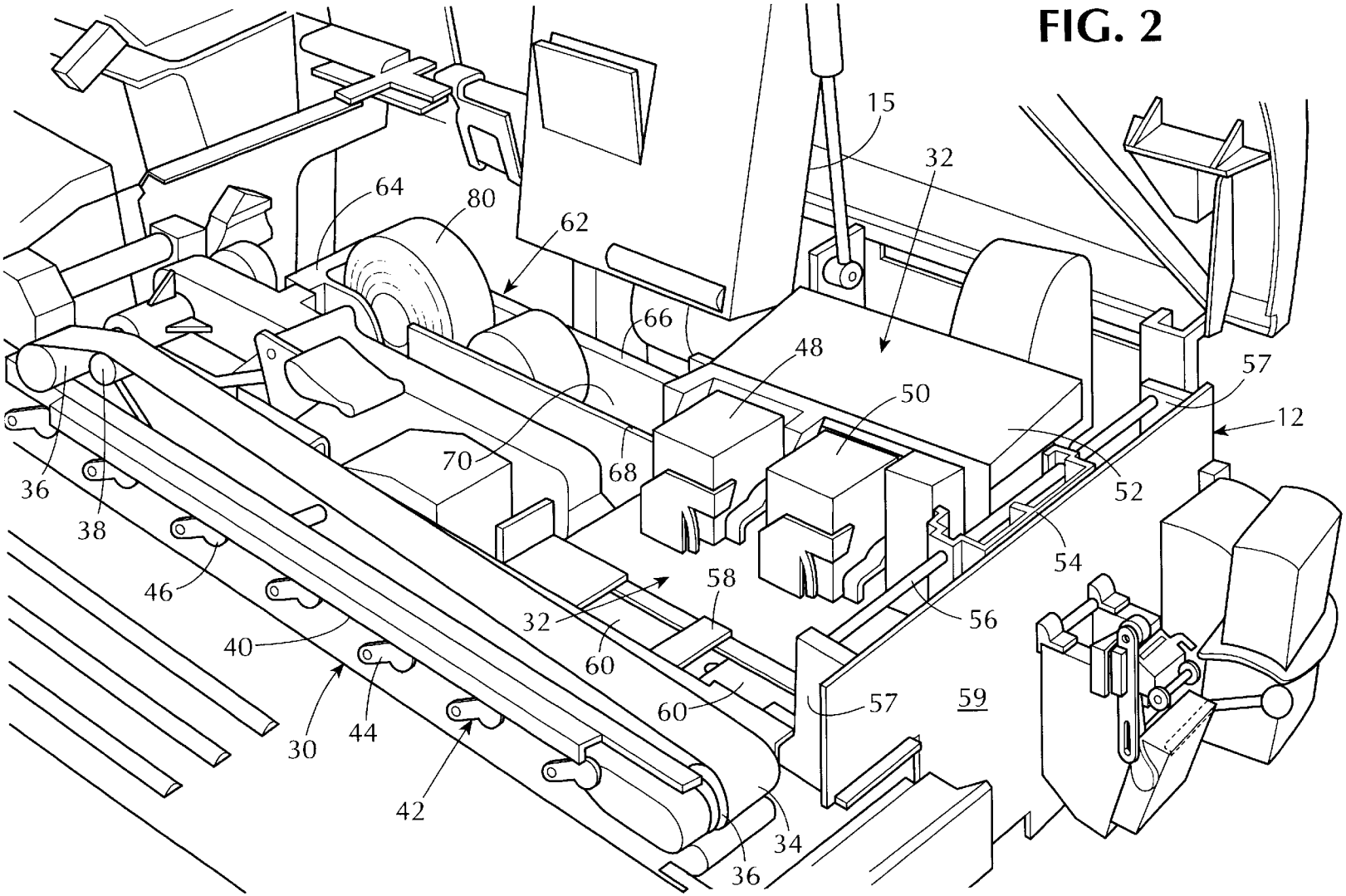
FIG. 2 is a perspective view of an interior portion of the mailing machine shown in FIG. 1 showing the location of the tape feeding mechanism of the present invention.

Referring now to the drawings and particularly to FIGS. 1 and 2 thereof, the reference numeral 10 designates generally an automatic high speed mailing machine of the type in which the present invention is utilized, and comprises an elongate base, designated generally by the reference numeral 12, which supports a feed deck 14 that extends substantially the length of the base 12. A user interface having a control panel and a information display unit, designated generally by the reference numeral 20, is suitably mounted on the mailing machine base 12 in the vicinity of a cover 18 so as to be conveniently accessible to an operator. The cover 18 encloses a suitable separating mechanism for withdrawing the bottom envelope of a stack and feeding it into the feeding mechanism that conveys it past the ink jet printing device further described below and provides jam access. Another cover, designated generally by the reference numeral 22, encloses most of the operating components of the mailing machine 10, including the tape storing and feeding mechanism described below, and can be raised to the dotted line position to afford an operator full access to the interior of the mailing machine 10. In the mailing machine 10 for which the tape storing and feeding mechanism of the present invention was designed, a weighing scale (not shown) is suitably integrated into the feed deck 14 for weighing mail pieces as they move along the feed deck so as to automatically set the postage meter to cause the printing device further described below to print an appropriate amount of postage. A postage meter (not shown) is detachably mounted to a meter pocket 15 located underneath the cover 22. The pocket is suitable mounted to the base 12 to be repositionable so as to allow access to the meter.

A plurality of nudger rollers 24 are mounted beneath the infeed end of the feed deck 14 and project upwardly through suitable openings in the feed deck 14 for the purpose of separating the bottom envelope from a stack of envelopes placed on top of the nudger rollers 24, the stack being confined by suitable rear and end walls 26 and 28 respectively. The nudger rollers 24 feed the bottom most envelope to a separating device (not shown) located beneath the cover 18, which ensures that only one envelope at a time is fed into the mailing machine 10. From the separating device, the envelopes are fed through a flap closing and sealing device (not shown) which is also located beneath the cover 18 which closes and seals the flaps to the rear panels of the envelopes. From there, the envelopes are fed into an elongate conveyor assembly, designated generally by the reference numeral 30 in FIG. 2, which conveys envelopes past an ink jet printing device, designated generally by the reference numeral 32, for printing the postage indicia on the upper right hand corner of the envelopes. The envelope conveyor 30 includes an endless belt 34 which extends around suitable drive rollers 36 suitably mounted on the mailing machine base 12, and a tensioning roller 38 to maintain proper tension on the belt 34. The belt 34 includes a lower run 40, and a plurality of back up pressure roller assemblies, designated generally by the reference numeral 42, are suitably mounted on the base unit 12 beneath the lower run 40 of the belt 34, each roller assembly 42 having a spring loaded arm 44 pivotally mounted on the base unit 12 and carrying a back up pressure roller 46 adjacent the free end of the arm 44. With this arrangement, the plurality of back up rollers 46 maintain an envelope in firm driving engagement with the lower surface of the lower run of the belt 34. Since the conveyor assembly 30 forms no part of the present invention, further description thereof is not deemed necessary for a full understanding of the present invention.

Figure 3:
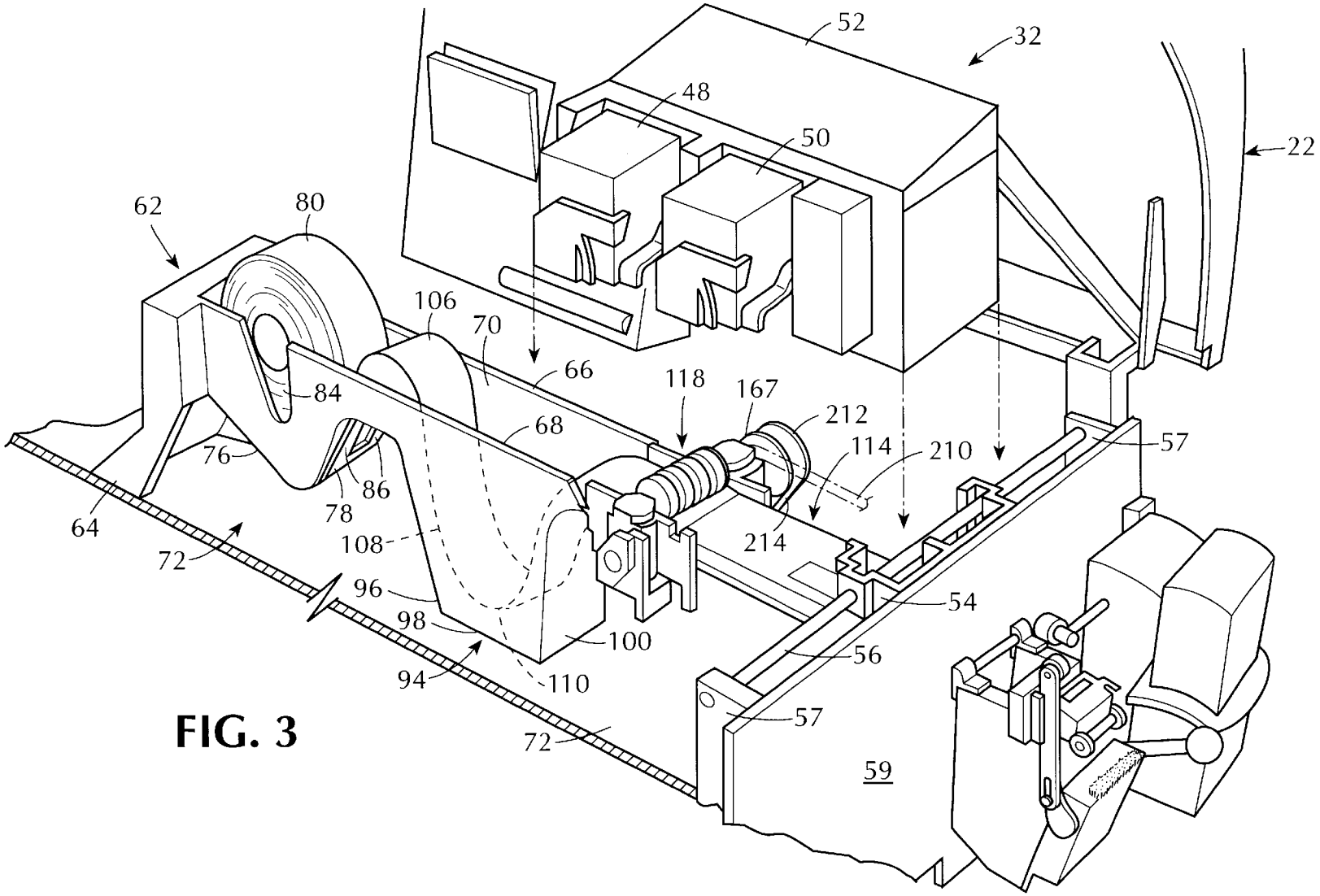
FIG. 3 is a perspective view of the tape feeding mechanism of the present invention shown in exploded orientation to the printing device of the mailing machine.

With particular reference to FIGS. 2 and 3, it will be seen that the ink jet printing assembly 32 is mounted in the mailing machine base 12 generally in a location toward the downstream end of the envelope conveyor 30 and spaced therefrom toward the rear portion of the mailing machine 10. The printing assembly 32 includes at least one but preferably a pair of digital ink jet print heads 48 and 50, which are suitably mounted on a housing 52. The housing 52 is suitably mounted on a frame 54 which in turn is mounted for lateral movement within the mailing machine base 12 between an intermediate position and two extreme positions, the printing assembly 32 being shown in FIG. 2 in the intermediate position. The frame is moved between the three positions by a threaded rod 56 suitably mounted on a standing portion 57 of the mailing machine base 12. The rod 56, when rotated in the opposite direction, cause the frame 54, housing 52 and print heads 48 and 50 to move forwardly or rearwardly within the frame 12 from the intermediate position shown in FIG. 2. The intermediate position is a stand-by or maintenance position in which the print head(s) of any ink jet printer is maintained when the printer is not in operation. When the printing assembly 32 is moved forwardly so that the frame 54 is contiguous with the forward portion of the rod(s) 56, the print heads 48 and 50 are moved to a position overlying a guide plate 58 having a pair of apertures 60 through which the print heads 48 and 50 direct the ink from the nozzles on the lower end of the print heads 48 and 50 onto the surface of an envelope being conveyed past the location of the guide plate 58 by the conveyor assembly 30.

Figure 11:
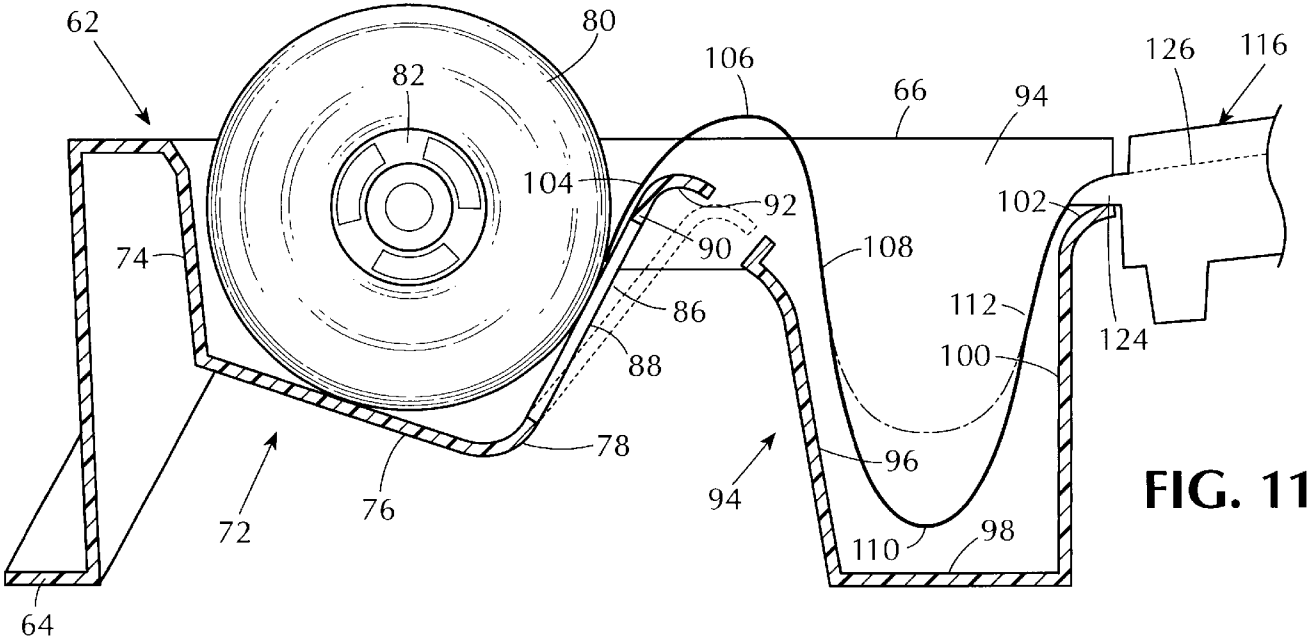
FIG. 11 is a side sectional view of the tape storage device shown in FIG. 3 but drawn to an enlarged scale.
Figure 12:
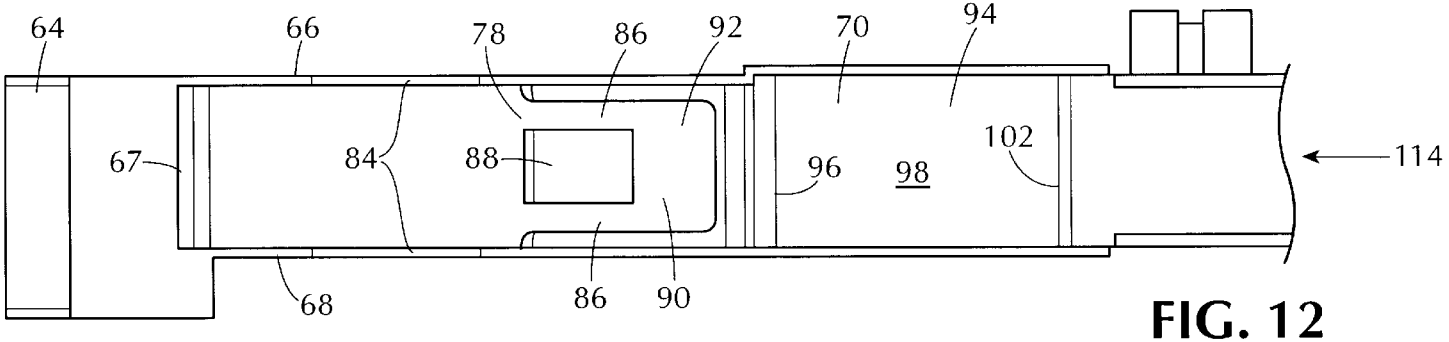
FIG. 12. is plan view of the tape storage device shown in FIGS. 3 and 11 but with the roll of tape removed.
Figure 13:
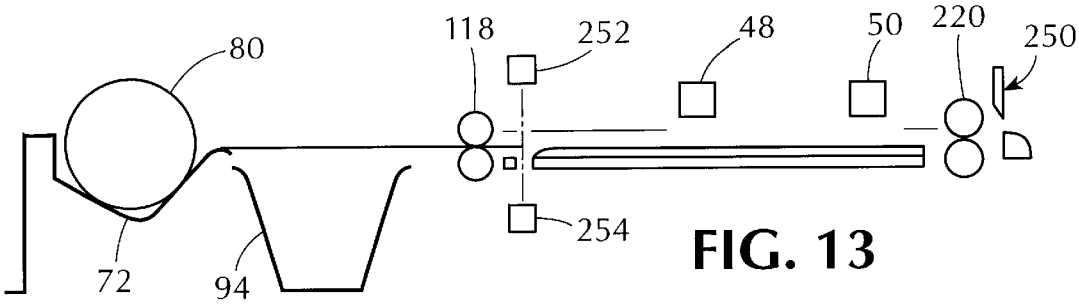
FIGS. 13–17 are diagramatic views of the tape feeding and supporting means showing the position of various portions of the tape during a complete cycle of operation of the mailing machine in printing a postage indicia on a discrete section of the tape.

With the foregoing description as background, the following description of the construction, orientation within the mailing machine 10 and operation of the tape storing and feeding mechanism of the present invention will be better understood. With particular reference to FIGS. 2, 3, 11 and 12, the tape storing and feeding mechanism comprises an elongated tape storing means, designated generally by the reference numeral 62, which, as best seen in FIG. 2, is located generally rearwardly of the upstream end of the envelope conveyor 30. The tape storing means 62 is preferably formed as a one-piece, molded plastic receptacle having a rear supporting section 64, and a pair of upstanding side walls 66 and 68 which define an upper open trough 70 which extends the full length of the tape storing means 62. The storing means 62 is suitably removably secured to a plate 71 which is part of the base 12 of the mailing machine 10. As best seen in FIG. 11, the storing means 62 includes an upstream well, designated generally by the reference numeral 72, which is defined by an upstream end wall 74, upstream portions of the side walls 66 and 68, an upstream bottom wall 76 which slants downwardly at a shallow angle from left to right as viewed in FIGS. 3 and 11, and a first intermediate wall 78 which slants sharply upwardly in the same direction. The upstream well 72 is adapted to hold a roll 80 of tape of indefinite length which is wound on a suitable spindle 82 which is easily manually accessible through the slots 84 in the upstream portions of the side walls 66 and 68 formed in the central portion of the upstream well 72. The first intermediate wall 78 is integrally connected to the bottom wall 76, but is free standing from that point on, in that the forward wall 78, as best seen in FIG. 12, is formed as a pair of wall portions 86 forming an elongate aperture 88 therebetween, and which join together adjacent the upper end of the first intermediate wall 78 in a solid portion 90 which has a curved upper edge 92. As best seen in FIG. 12, the upper edge 92 of the first intermediate wall 78 is not connected to the side walls 66 and 68, as is the bottom portion, with the result that the upper edge 92 is free to move back and forth a limited distance due solely to the resilience of the plastic material from which the tape storing device 66 is formed. Wall 78 thus forms an elongated resilient element which absorbs the initial shock as the tape is accelerated, reducing the possibility that the tape might break. The tape storing device 62 further includes a downwstream well, designated generally by the reference numeral 94, which is defined by a second intermediate wall 96, a bottom wall 98 and a downstream end wall 100 which terminates upwardly in a forwardly curved lip 102, which constitutes a forward supporting means device 62, again, all for a purpose to be made clear hereinbelow.

Still referring to FIGS. 3 and 11, it will be seen that, in the normal, unstressed condition of the tape from the roll 80 when the mailing machine 10 is not in operation, the roll 80 rests against the forward wall 78 by gravity due to the downward slant of the bottom wall 76, and a portion 104 of tape from the roll 80 projects upwardly along the first intermediate wall 78 to form an upwardly projecting reverse loop portion 106 which joins with a downwardly extending portion 108 which extends downwardly into the well 94 for a major portion of the depth of the well 94, as shown by the dotted lines in FIG. 3. The portion 108 then joins with a downwardly projecting reverse loop portion 110 which joins with an upwardly extending portion 112, the upper end of which is closely adjacent to the upper lip 102 of the downstream end wall 100 of the well 94. A further portion of the tape, as well as the functions of the previously described portions, will be further described hereinbelow.

As best seen in FIG. 3, an elongated tape feeding and supporting means, designated generally by the reference number 114, extends from the upper forwardly curved lip 102 of the tape storage device 62 to the forward wall 57 of the mailing machine base 12 for the purpose of feeding a discrete length of tape from the roll 80 thereof and supporting it beneath the print heads 48 and 50 of the printing device 32 in a manner now to be described. With reference to FIGS. 3 through 11, it will be seen that the tape feeding and supporting means 114 comprises essentially three major parts, a tape supporting bridge, designated generally by the reference numeral 116, an upstream and downstream tape feeding mechanism, designated generally 118 and 120 respectively, and a cover device, designated generally by the reference numeral 122, for supporting the bridge 116. As previously mentioned, it is important in a ink jet printer to maintain the proper gap between the surface upon which printing takes place and the plane of the print head nozzles, and this is particularly difficult to maintain in a paper handling situation where the paper must be registered against the top surface rather than the bottom, as is the case in more customary ink jet printing applications. In the present invention, the supporting bridge 116 is the structure by which the tape is supported during the printing operation and therefore which must maintain the proper gap between the upper surface of the tape and the ink Jet nozzles. This is accomplished by molding the supporting bridge 116 from a plastic composition that is essentially a glass and carbon filled nylon material which provides a high degree of rigidity, dimensional control, static dissipation, resistance to warping and a smooth, virtually friction free surface on which the tape moves, and is also resistant to inks.

Figure 4:
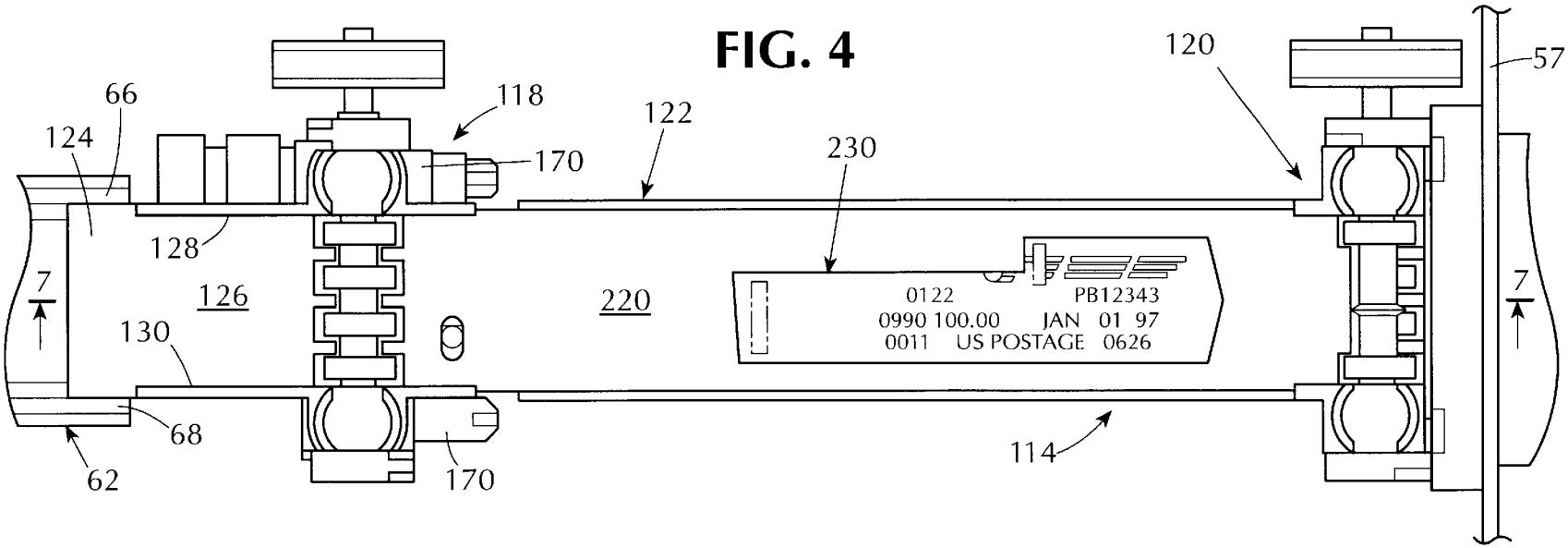
FIG. 4 is a plan view of the tape feeding and supporting means with the cover member in place and showing a discrete length of tape in the position it would occupy just after a printing operation ha taken place.
Figure 7:
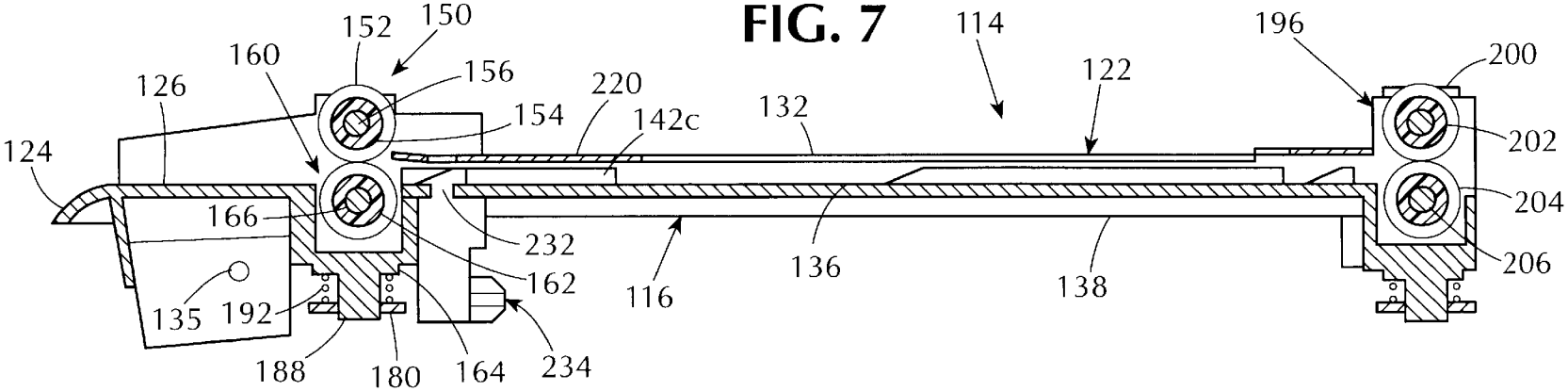
FIG. 7 is a side view of the tape feeding and supporting means shown in FIG. 6.

As best seen in FIGS. 4, 7 and 11, the supporting bridge 116 has a lip 124 which is upwardly curved in the direction of feed of the tape and which is adapted to fit over the upper forwardly curved lip 102 of the downstream wall 100 of the tape storage means 62, the lip 124 also having a lateral dimension that is slightly less than that of the side walls 66 and 68 so as to fit therebetween and rest on the upper lip 102. Thus, as best seen in FIG. 11, the tape will slide very easily over the transition from the lip 102 on the wall 100 to the lip 124 on the bridge 116. The bridge 116 then has a relatively short infeed ramp portion 126 that is slightly inclined in the direction of feed, and a pair of side walls 128 and 130 which are spaced apart a distance substantially equal to the width of the tape, leaving just enough clearance so that the tape can pass freely between the walls 128 and 130. The walls 128 and 130 assist with aligning the tape when tape reloading is necessary The ramp portion 126 merges adjacent the upstream feeding mechanism 118 with a relatively long tape supporting portion 132 which extends from the location of merger to the upstanding wall 57 of the mailing machine base 12, to which the downstream end of the supporting portion 132 adjacent the downstream feeding mechanism 120, is suitably secured as by the locating pin 134. The bridge 116 is also provided with a pair of apertures 136 (FIG. 7) on a depending portion of the bridge 112 beneath the ramp 126 through which pins pass to connect the upstream end of the bridge 116 to a portion of the mailing machine base 112.

Figure 9:
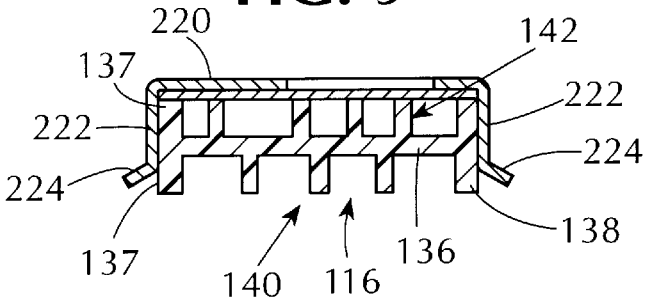
FIG. 9 is a sectional view taken on the line 9—9 of Fig. showing details of the upper and lower rib construction of the tape supporting bridge.

Due to the criticality of maintaining the proper gap between the plane of the ink jet nozzles and the printing surface of the tape, the bridge 116, including both the ramp portion 126 and the tape supporting portion 132, is formed as a continuous flat strip 136 which has integrally molded downwardly and upwardly projecting side edges 137 and 138 respectively (FIG. 9), thereby forming in cross section a laterally elongated "H" configuration. The bridge 116 also has a plurality of depending and upstanding ribs 140 and 142 respectively molded integrally with the upper and lower surfaces of the strip 136 (FIGS. 7 and 9). The depending ribs 138 extend substantially the full length of the bridge 116, while the upstanding ribs 142 are discontinuous and have a unique configuration as further described below. One function of the ribs 140 and 142 is to prevent warping during the molding process, since it is known that when molding a flat piece with ribs formed on one side, the flat piece tends to warp slightly and bow due to unsymmetrical cooling which occurs during the molding process, which, in the case of the bridge 116, would cause the gap between the printing surface of the tape and the plane of the jet nozzles to vary across the printing area, resulting in an indicia of unacceptable print quality. The other function is to lend sufficient strength and rigidity to the bridge 116 to prevent any possibility that it can warp or is otherwise change shape through prolonged use or damage from mishandling during the life of the mailing machine 10.

Figure 6:
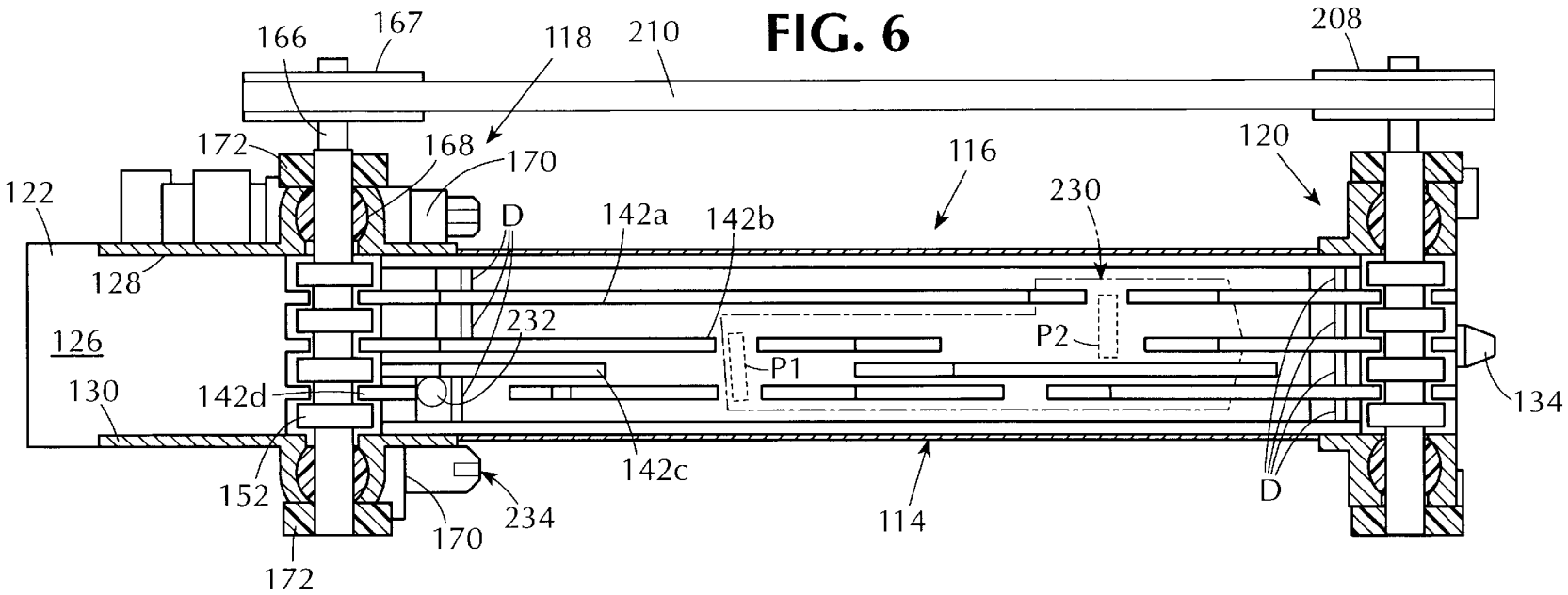
FIG. 6 is a sectional view taken on the line 6—6 of Fig. showing the details of the rib construction of the tape supporting means.

With particular reference to FIGS. 6 and 7, it will be seen that the upstanding ribs 142 are of different lengths and are positioned in different locations on the upper surface of the flat strip 136. A first group of ribs, labeled 142*a*, 142*b*, 142*c* and 142*d* commence substantially at the juncture of the infeed ramp 126 and the flat strip 136, just on the downstream side of the feeding mechanism 118. As best seen in FIG. 7, the upstream ends of these ribs are depressed below the nip of the feed rollers 152 and 162 of the upstream feed mechanism 118 to ensure that the lead edge of the tape will feed smoothly onto the ribs. The rib 142*a* extends in the downstream direction of tape feed for a major portion of the length of the tape supporting portion 136, the rib 142*b* extends in the same direction for only a minor portion of the length of the supporting portion 136, the rib 142*c* extends for a slightly less distance than the rib 142*b*, and the rib 142*d* is a very short rib disposed adjacent the lower feed roller 162 and terminates at an aperture 232 formed in the bottom wall of the tape supporting portion, below which a suitable tape edge detection device, designated generally by the reference numeral 234 which detects the arrival of the leading edge o e tape at the location of the aperture 232 for a purpose to be fully explained below.

By cutting away upper rib 142 in the regions P1 and P2 (FIG. 6) directly below print heads 48 and 50, ink discharged from print heads 48 and 50 (either accidentally or to purge the print heads) does not contaminate the upper surface along which the tape moves. Other portions of ribs 142 are cut away to allow ink to accumulate in the entire volume defined by ribs 142, which it is estimated to be sufficient to contain any amount of ink likely to accumulate in the life of a machine. Dams D are provided to prevent ink from flowing from this volume and contaminating the printer.

Figure 8:
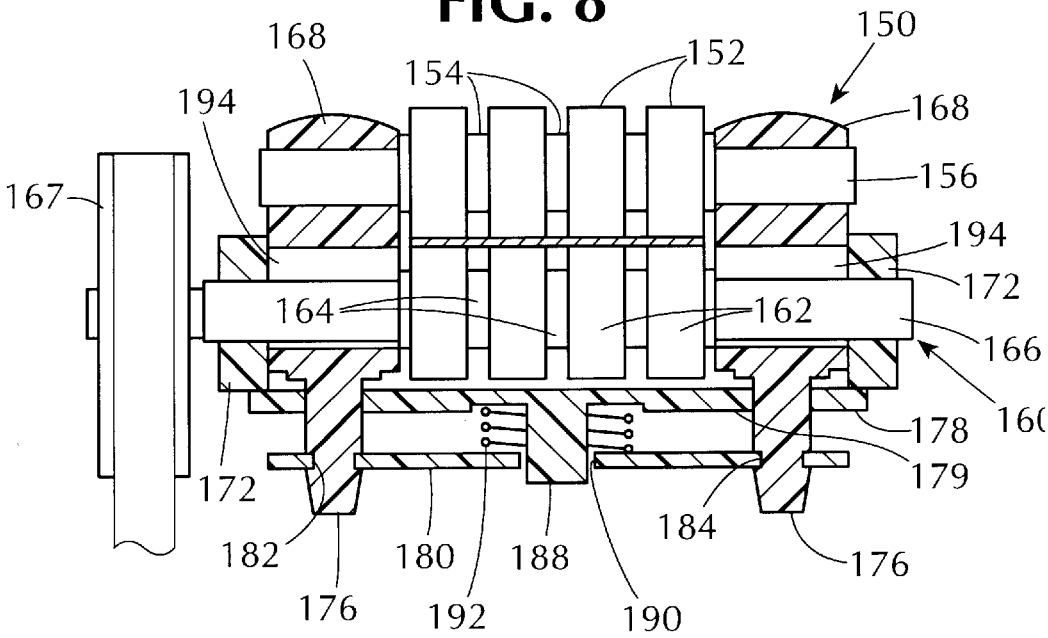
FIG. 8 is a sectional view taken on the line 8—8 in Fig. showing details of construction of the upstream feeding mechanism.

With particular reference now to FIGS. 4 through 8, the upstream tape feeding mechanism 118 is seen to comprise an upper roller assembly designated generally by the reference numeral 150 which comprises a roller having a plurality of large diameter segments 152 separated by smaller diameter segments 154, the roller being mounted on an upper shaft 156. The feeding mechanism 118 also includes a lower roller assembly designated generally by the reference numeral 160 which also comprises a roller having a plurality of large diameter segments 162 separated by smaller diameter segments 164 which are located in a complimentary manner to the large and small diameter segments 152 and 154 of the upper roller assembly 118. The lower roller is mounted on a lower shaft 166, on one end of which is mounted a pulley 167. As best seen in FIG. 8, the upper shaft 156 is journaled for rotation in the upper ends of a pair of elongated bearing blocks 168 which are mounted for limited vertical movement in a pair of suitable bearing housings 170 formed integrally with the upstream end of the tape support bridge 116 on both sides thereof. The lower shaft 166 is journaled for rotation in a pair of bearing plates 172 (FIG. 5) which are suitably secured to the bearing housings 170 as by the screws 174.

Each of the bearing blocks 168 project downwardly sufficiently far to terminate in bifurcated projections 176 which extend beyond the bottom surface 179 of a portion of the support bridge 116 which extends between the bearing housings 170, and an elongated plate 180 extends across the width of the bearing housings 170 and is mounted on the bifurcated projections 176 of the bearing blocks 168 by means of apertures 182 formed adjacent each end of the elongated plate 180 and which are of smaller diameter than the projections 176, but which engage with an annular slot 184 formed in each projection 176 by compressing the legs of the bifurcated projections when the plate 180 is pressed over the projections 176. A downwardly extending center stud 188 is formed integrally with the bottom surface 178 and is received in a center aperture 190 formed in the elongated plate 180. A compression spring 192 is captured around the stud 188 between the upper surface of the elongated plate 180 and the bottom surface 178 of the portion of the support bridge 116 that extends between the bearing housings 170 so as to exert a downward force on the upper shaft 156, thereby pressing the large diameter segments 152 of the upper roller into firm engagement with the corresponding segments 162 of the lower rollers so as to exert a firm driving engagement with the tape therebetween, as best seen in FIG. 8. The bearing blocks 168 are provided with elongated slots 194 to provide for the limited movement thereof.

Figure 10:
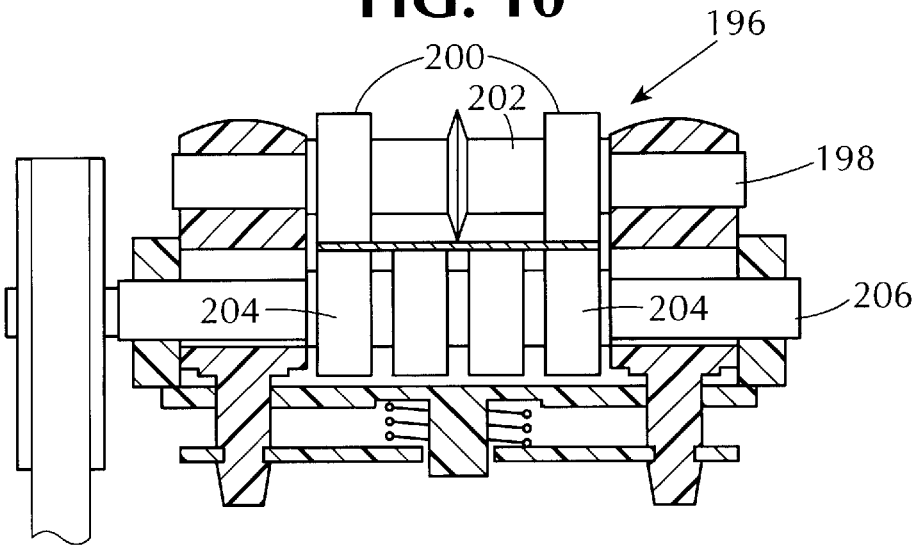
FIG. 10. is a sectional view taken on the line 10—10 in FIG. 5 showing details of construction of the downstream feeding mechanism.

So far as described, the downstream roller assembly 120 is identical to that of the upstream roller assembly with the exceptions now described. With reference to FIG. 10, it will be seen that the upper roller assembly designated generally by the reference numeral 196 still comprises an upper shaft 198, but in this assembly the upper roller has only two large diameter segments 200 with an elongated smaller diameter segment 202 extending therebetween, with the result that the tape is engaged only between the large diameter segments 200 of the upper roller and the corresponding outermost larger diameter segments 204 of the lower roller. It should also be noted that the lower shaft 206 for the lower roller has a pulley 208 mounted on the end thereof that corresponds to the end of the lower shaft 176 which carries the pulley 167, and a timing belt 210 extends between the pulleys 176 and 208 so that the shafts 166 and 206 are driven in synchronism at the same velocity. As best seen in FIG. 3, a second pulley 212 is mounted on the lower shaft 166 of the lower roller assembly 160, and a drive belt 214 is connected between this pulley and a suitable motor mounted in the base 12 of the mailing machine, with the result that the shaft 166 is the main drive shaft for both the upstream and downstream tape feeding mechanisms 118 and 120.

In a preferred embodiment of the invention, a knife edge roller (not shown) having a narrow contact surface is positioned between rollers 200 so as to bear upon an unprinted portion of the tape in order to prevent the tape from bowing upwards and coming into contact with cover 220 after the indicia is printed and while the ink is still wet, as well as to guide entrance into downstream paths (not shown).

Figure 5:
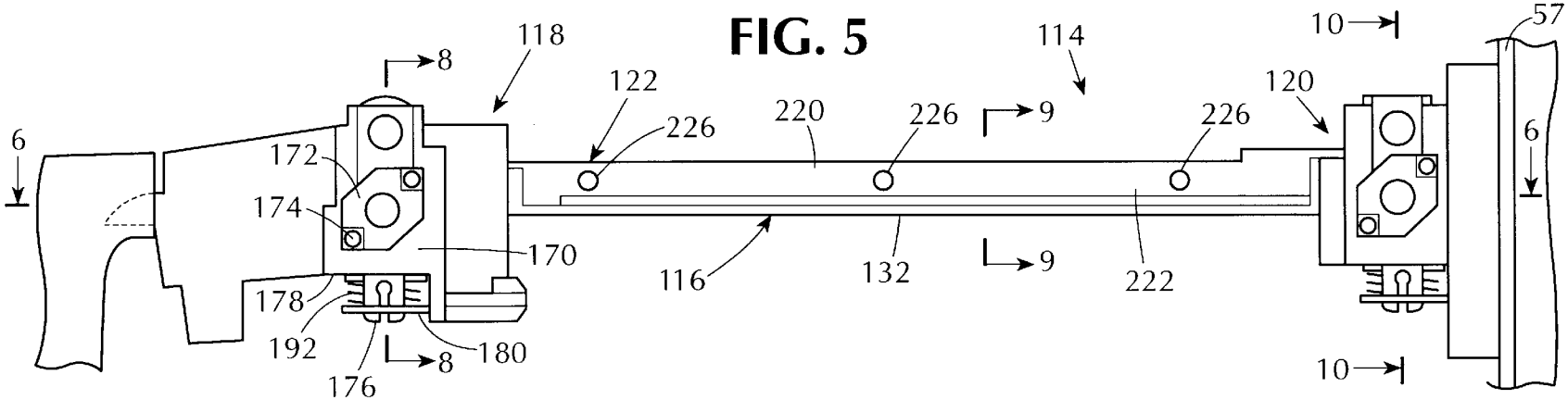
FIG. 5 is side view of the tape feeding and supporting means shown in FIG. 4.

Referring now particularly to FIGS. 4, 5 and 9, the cover device 122 which extends over the top of the tape supporting bridge 116 is seen to comprise an elongated strip of sheet metal 220 which extends substantially from the nip of the rollers in the upstream and downstream tape feeding mechanisms 118 and 120, and is adapted to lie on the upper surface of the upwardly projecting side edges 138. A pair of side edges 222 extend downwardly and terminate in short laterally outwardly angled flanges 224. The cover device 122 is removably retained in place on the supporting bridge 116 by means of a plurality of projections (not shown) which are engaged by the detents 226 formed on the side edges 222 of the cover device 122.

The cover device 122 is provided with an elongated aperture designated generally by the reference number 230 in FIGS. 4 and 6.

FIGS. 13 through 17 show a schematic representation of the operation of the tape feeding and supporting mechanism of the subject invention. Initially, tape from roll 80 is held substantially tautly above well 94 by upstream feeding mechanism 118. Detector 252 and light source 254 detect the leading edge of the tape to synchronize operation of the tape storing and feeding mechanism of the invention with operation of print heads 48 and 50.

Figure 14:
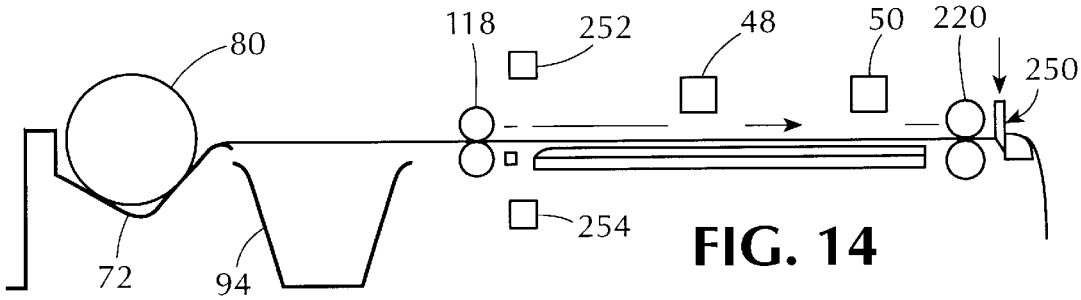

In FIG. 14, feeding mechanism 118 advances the tape past print heads 48 and 50, which print an indicia, until the tape is engaged by downstream feeding mechanism 120 which continues to advance the tape until it is severed by conventional severing mechanism 250.

Figure 15:
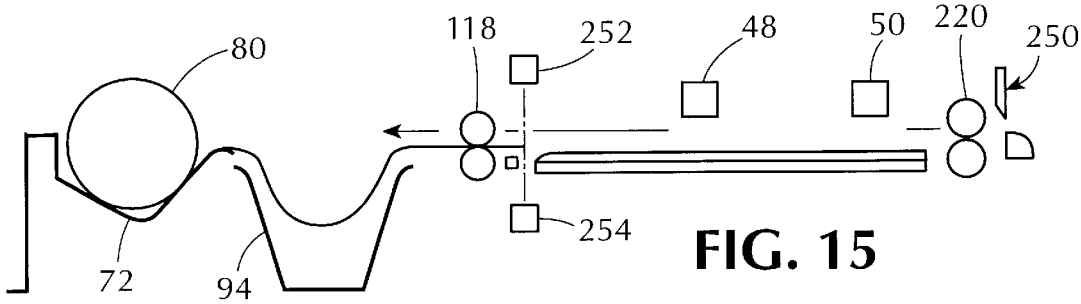

Then, in FIG. 15, the tape storing and feeding mechanism reverses and withdraws the tape to the initial position, forming a loop in well 94. By reversing the tape, wastage of the portion of the tape drawn past print heads 48 and 50 before the printed indicia is severed is avoided.

Figure 16:
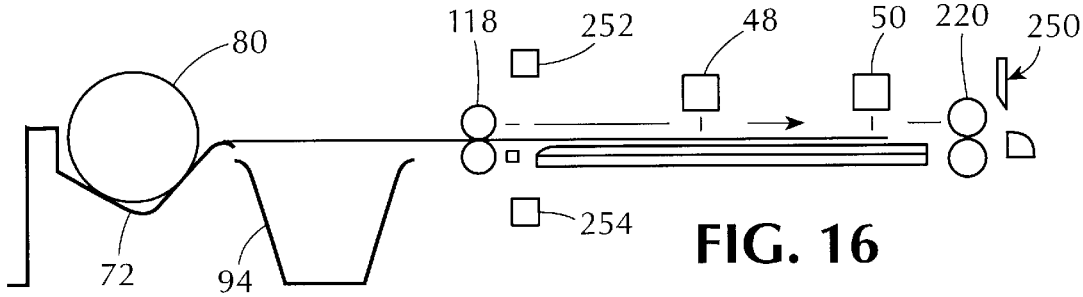
Figure 17:
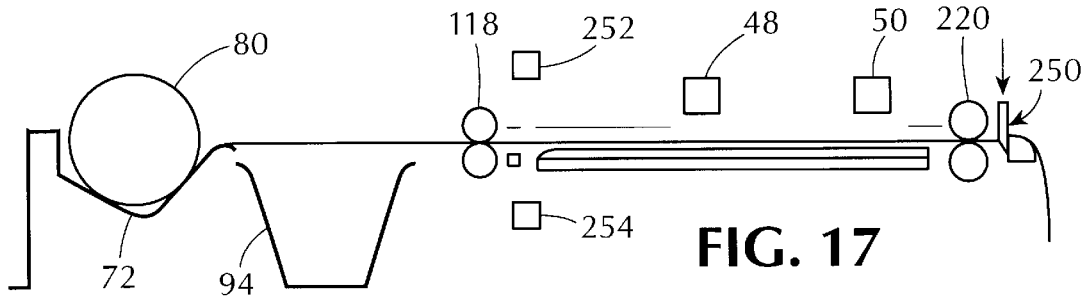

In FIG. 16, feeder mechanism 118 again advances the tape for printing, and in FIG. 17 the indicia is printed and the tape advanced by feeder mechanism 120 and the cycle repeats.

What is claimed is:

1. A method for storing and feeding a roll of tape for an ink jet printer having at least one ink jet print head having an array of ink jet nozzles in a lower surface thereof for printing a portion of an indicia on discrete portions of a web of tape stored in said printer, the steps comprising:

a) advancing a tape web, from a tape roll stored in a first well, across an upstream feeding means, along an elongated tape supporting means to a downstream feeding means;

b) printing an image on said tape web;

c) advancing said printed tape web across said downstream feeding means;

d) further advancing said tape web past a cutting means;

e) cutting said printed tape web; and, f) retracting said tape web to said upstream feeding means, forming a loop of tape in a second well downstream from said first well.

2. A method as claimed in claim 1 further including the step of providing a plurality of ribs projecting upwardly and downwardly respectively from upper and lower surfaces of said tape supporting means and extending substantially from one end of said supporting means to the other.

3. A method as claimed in claim 2 further including the step of providing said plurality of ribs with a pair of opposed side ribs forming apposite outer edges of said tape supporting means and providing said side ribs with a latching means and providing a cover having an interior surface spaced from and substantially parallel to said upper surface of said tape supporting element, further forming an opening between said interior surface and said printer and side flanges for releasably engaging said latching means to position said interior surface with a predetermined clearance above said upper surface, selecting said clearance to hold said tape between said upper surface and said interior surface as said tape moves over said tape supporting element.

4. A method as claimed in claim 3 further including the step of providing cut aways in said ribs adjacent to said print head, whereby said upper surface is not contaminated by ink discharged from said print head in the absence of said tape and said ink can accumulate on said lower surface without interfering with operation of said printer.

5. A method as claimed in claim 4 further including the step of biasing said roll against an extended resilient portion of said front wall and absorbing a portion of the force applied to said roll by said tape feeding and supporting means when feeding said tape.

6. A method as claimed in claim 1 further including the step of biasing said roll against an extended, resilient portion of said front wall and absorbing a portion of the force applied to said roll by said tape feeding and supporting means when accelerating said tape.

7. A method as claimed in claim 1 further including the step of providing cut aways in said ribs adjacent to said print head, whereby said upper surface is not contaminated by ink discharged from said print head in the absence of said tape and said ink can accumulate on said lower surface without interfering with operation of said printer.

8. A method as claimed in claim 6 further including the step of providing cut aways in said ribs adjacent to said print head, whereby said upper surface is not contaminated by ink discharged from said print head in the absence of said tape and said ink can accumulate on said lower surface without interfering with operation of said printer.

* * * * *